US006637693B1

(12) United States Patent
Kaufmann et al.

(10) Patent No.: US 6,637,693 B1
(45) Date of Patent: Oct. 28, 2003

(54) YARN FEED DEVICE HAVING A WEIGHT-RELIEVING STOP ELEMENT

(75) Inventors: Richard Kaufmann, Freudenstadt (DE); Herman Schmodde, Horb-Dettlingen (DE)

(73) Assignee: Memminger-IRO GmbH (DE)

( * ) Notice: Subject to any disclaimer, the term of this patent is extended or adjusted under 35 U.S.C. 154(b) by 16 days.

(21) Appl. No.: 10/030,795

(22) PCT Filed: Jul. 6, 2000

(86) PCT No.: PCT/DE00/02208

§ 371 (c)(1),
(2), (4) Date: Mar. 28, 2002

(87) PCT Pub. No.: WO01/04401

PCT Pub. Date: Jan. 18, 2001

(30) Foreign Application Priority Data

Jul. 12, 1999 (DE) ..... 199 32 483

(51) Int. Cl.[7] ..... B65H 51/02; H01H 9/00

(52) U.S. Cl. ..... 242/365.7; 200/61.17; 200/61.18

(58) Field of Search ..... 242/365.7, 365.6, 242/419.7; 200/61.17, 61.18

(56) References Cited

U.S. PATENT DOCUMENTS 706,840 A * 8/1902 Martin et al. ..... 200/61.18
1,506,152 A * 8/1924 Berdon ..... 200/61.18
2,128,476 A * 8/1938 Runton ..... 200/61.18
3,255,385 A * 6/1966 Gith ..... 200/61.18
3,806,677 A 4/1974 Deniega et al.
3,858,013 A 12/1974 Parent
3,867,592 A * 2/1975 Quellos ..... 200/61.18
3,896,640 A 7/1975 Pelencher
3,912,184 A * 10/1975 Bous ..... 242/365.6
4,043,155 A * 8/1977 Steinberg et al. ..... 66/132 T
4,271,687 A * 6/1981 Memminger et al. ..... 66/146
4,662,575 A * 5/1987 Fecker ..... 242/365.7
5,820,047 A * 10/1998 Paepke et al. ..... 242/366
5,860,298 A 1/1999 Chen

FOREIGN PATENT DOCUMENTS

EP 0 224 797 A 6/1987
GB 2 030 603 A 4/1980

* cited by examiner

*Primary Examiner*—Michael R. Mansen
(74) *Attorney, Agent, or Firm*—Leydig, Voit & Mayer, Ltd.

(57) ABSTRACT

A yarn feeder having one or more yarn feeler levers which rest on the yarn with a force which in the desired position of the lever, i.e. with a correct yarn run, is small. If the lever is pivoted out because the yarn tension is decreased or the yarn has broken, the force with which the lever rests on the yarn increases. This is achieved in the illustrated yarn feeler by a relief device which partially compensates for the weight of the lever and provides a compensating force as a function of the pivot angle. The compensating force preferably decreases with an increase in further pivotal movement of the lever.

20 Claims, 4 Drawing Sheets

YARN FEED DEVICE HAVING A WEIGHT-RELIEVING STOP ELEMENT

FIELD OF THE INVENTION

The invention relates generally to a yarn feeder for feeding yarn to a textile machine, and more particularly, to a yarn feeder for feeding at least one yarn to a textile machine having a base support on which at least one lever can be pivoted around a horizontal pivot axis with an end remote from the pivot axis is in contact with the yarn under the force of its own weight.

BACKGROUND OF THE INVENTION

Devices for monitoring whether yarn running into or out of a yarn feeder is proper, and whether the yarn delivered by the yarn feeder is provided in the correct amount or with the correct tension, often are provided on yarn feeders. In both cases hoop-shaped levers often are provided, which are pivotably seated on the yarn feeder and with an outer end resting on the yarn.

Such a yarn feeder, for example, is known from U.S. Pat. No. 5,860,298. The yarn feeder has a yarn feeding drum fastened on a vertical shaft and arranged in a yarn delivery path. Yarn feeler levers, which extend downwardly and in oblique fashion and rest with their free ends on the yarn, are arranged in the yarn delivery path upstream and downstream of the yarn feeding drum. If the yarn breaks, or too large an amount of yarn is present, the levers pivot downward under the force of their own weight and in the process actuate switches, which for example can be used for stopping the downstream-located textile machine.

The levers are pivoted under the force of their own weight. This must be a minimum weight in order to assure a dependable pivot movement, even if the yarn feeder is subjected to a certain amount of soiling in the course of the actual operating conditions. On the other hand, this results in increased friction at the yarn guide lever, which can be disadvantageous in particular in connection with thin and/or delicate yarns. If a particularly low yarn tension is desired, problems arise from too large a contact force, particularly because the yarn feeler lever tensions the yarn. The minimal yarn tensioning force must be great enough for the yarn to lift the yarn feeler lever.

OBJECTS AND SUMMARY OF THE INVENTION

Based on the foregoing, it is the object of the invention to provide a yarn feeder with a feeler lever that overcomes the foregoing problems and which is particularly adapted for use in controlling the feed of thin and delicate yarns.

In accordance with the invention, the lever, which is pivotably seated on the base support, is connected with a relief device, which reduces the weight of the lever by means of a spring force in at least a portion of its pivot range. Thus, the relief device enables the lever to rest on the yarn with a comparatively reduced force. By means of such device it is possible to reduce the friction between the yarn and the respective location of the lever. Moreover, it is possible to monitor even relatively thin yarn and/or to operate at reduced yarn tension.

Preferably the reduction of the weight of the lever is a function of the pivot angle. It is possible in this way to realize a deflection-dependent contact force on the yarn, which depends on the deflection angle of the lever in a non-linear manner. This can increase the triggering dependability, even if the yarn feeder is subjected to soiling.

Spring elements for generating a force which counters the weight permit a weight reduction without causing a noticeable increase in the moment of inertia of the lever, so that the latter can rapidly respond to a yarn break or decreasing yarn tension.

Wear-reducing ceramic elements can be arranged on the yarn feeler element. The weight relief compensates their weight at least partially. The service life of the elements which are in contact with the yarn can thereby be increased by the ceramic elements.

Preferably the spring element acts on the lever by means of a lever arm of such a type, that a neutral point is provided in the pivot range, wherein the spring element does not introduce a torque into the lever. The sign or direction of the torque is reversed in this neutral point, so that the spring element switches from a weight relief to an additional weight. This can increase the switch-off dependability.

Preferably the spring element is part of an electrical switch, so that no additional switch actuation forces need be provided. The force generated for the weight relief is also the switch-off force. This has the significant advantage that the full (not relieved and reduced) weight of the lever is available for actuating the switch, although the lever has been relieved of the weight from the viewpoint of the yarn.

For example, the spring element can be in the form of a U-shaped spiral spring. In addition, the latter can advantageously be used as a switching element. If the spiral spring has comparatively long legs, i.e. the legs are longer than their distance from each other, the spiral spring element is pivoted out relatively strongly, even with a small pivot movement of the lever. It thereby can be used as a switching member of a switch, wherein good and clearly defined switching points are provided because of the possible gearing, i.e. the comparatively greater pivot movement of the spiral spring in comparison with the pivot movement of the lever.

Figure 1:
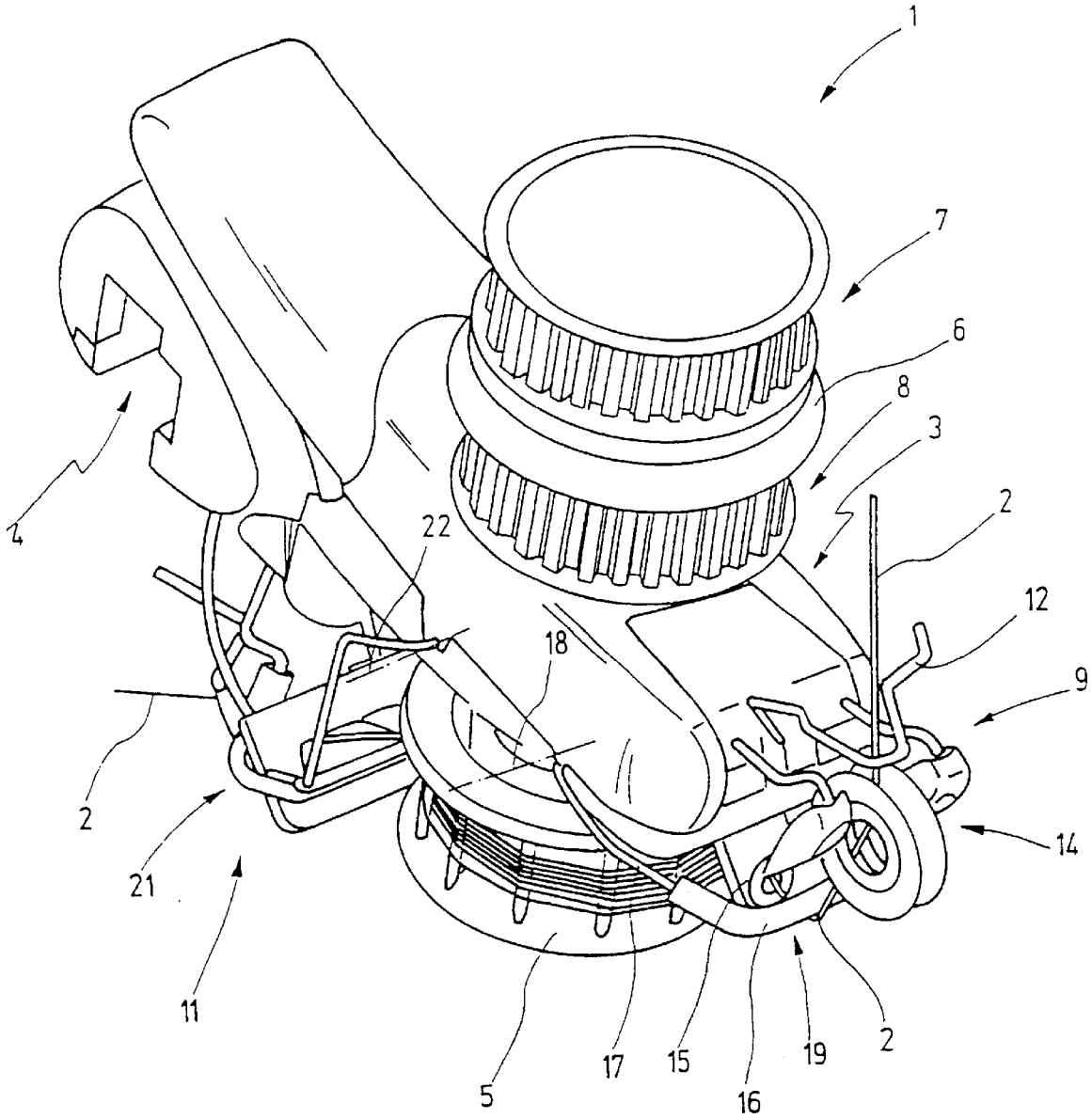
FIG. 1 is a perspective of an illustrative yarn feeder in accordance with the present invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown an illustrative yarn feeder 1 in accordance with the invention which is adapted for delivering yarn 2 to an appropriate textile machine (not shown). The illustrative yarn feeder 1 has a base support 3 with a fastening device 4 which may be connected to the textile machine, or to a holder provided on the textile machine. The base support 3 in this case is defined by a dual-shell housing. The yarn feeder 1 includes a yarn feeding drum 5 which in this case is mounted on a lower end of a vertical drive shaft rotatably carried by the base support 3. The other or upper end of the shaft is connected via a clutch disk 6 with drive disks 7, 8.

The yarn 2 is wound several times around the yarn feeding drum 5 and, when the latter is rotatingly driven, is positively delivered to the downstream-connected textile machine. Yarn guide elements 9, 11 are arranged in its running path for continued guidance of the yarn 2. The yarn guide elements include a yarn inlet eye 12, a yarn brake device 14 and an inlet eye 15 arranged between the yarn brake device 14 and the yarn feeding drum 5.

A feeler lever 16 is arranged on the yarn inlet side between the yarn brake device 14 and the inlet eye 15. The feeler lever 16 in this instance has a hoop-shape, with two legs 17 extending around the base support 3 with ends seated on or in the base support for pivotal movement about a pivot axis 18. The yarn feeler lever 16 rests with its end 19, which is provided with a wear-reducing coating or a wear-reducing element, on the yarn 2. This can be seen in FIG. 2 in particular.

A further feeler lever 21 is provided on the outlet side of the yarn feeder 1, which is mounted for pivotable movement around a horizontal pivot axis 22 on the base support 3. The yarn feeler lever 21 also has a hoop shape and on its lower free end has an eye 23 made of a resistant material such as ceramic. In this case, the eye 23 is essentially arranged between two yarn eyes 24, 25 which are part of the yarn guide element 11, and rests on the yarn 2. If the latter is tensed, it lifts the eye 23 between the yarn guide eyes 24, 25. In the area of contact with the yarn, the eye 23 has a very large radius which prevents sharp yarn deflections. The eye 23 is wear-resistant to a large extent with respect to the yarn. The eye 23 also can be a ceramic-coated shaped element which, however, also increases the weight of the shutoff element.

Both levers 16, 21 are shown lifted out of their freely downwardly suspended position by the yarn 2. If the yarn tension ceases, the levers 16, 21 pivot downwardly. In the process they actuate an electrical switch, which is connected with contact elements 26 arranged in the area of the fastening device 4. An indicator lamp 27 is additionally triggered to signal the status which has occurred.

Figure 4:
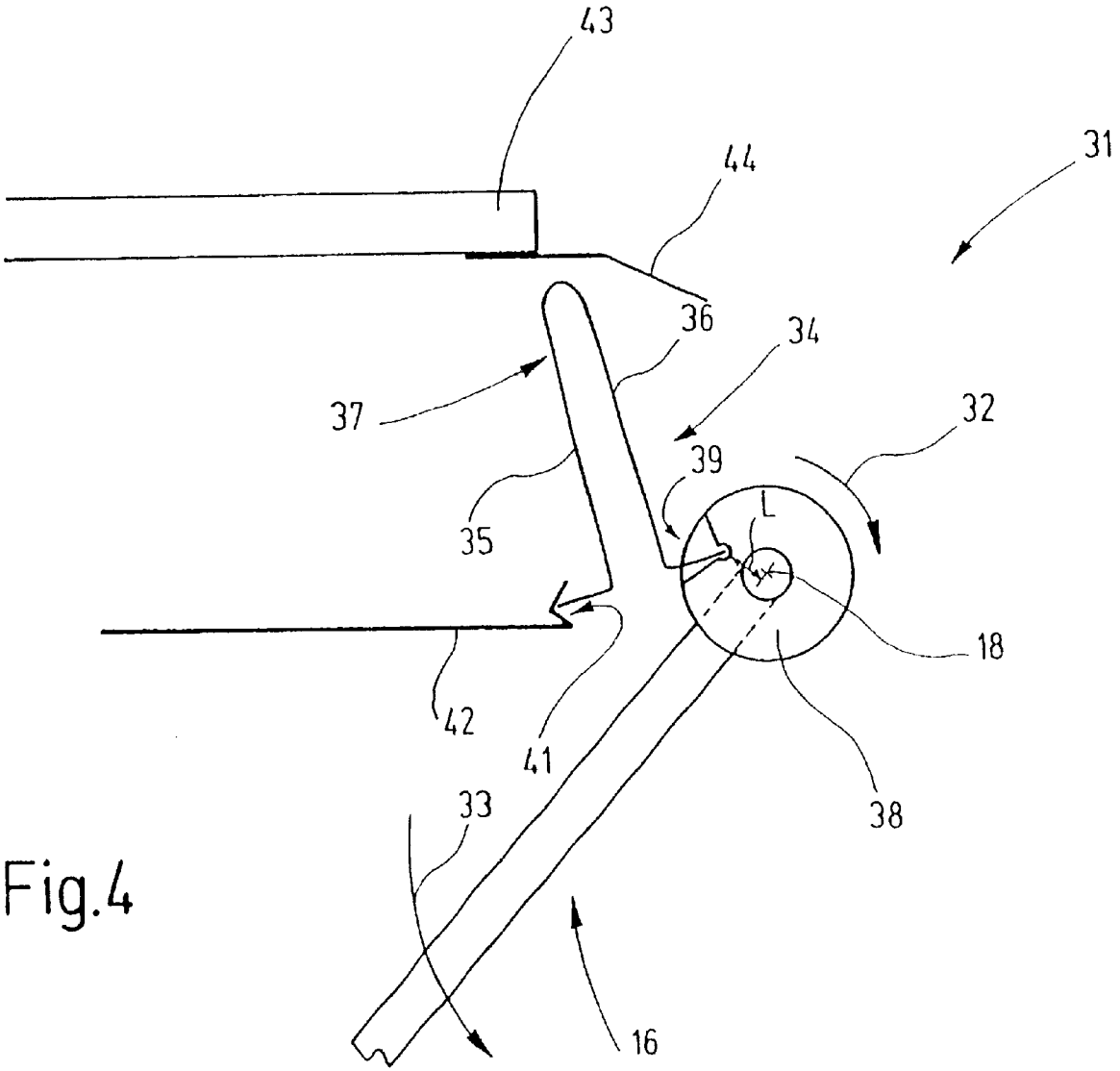
FIG. 4 is a partially schematic side elevational view of the weight relief mechanism of the illustrated yarn feeder.

The yarn guide levers 16, 21 are weight-relieved. This means that they do not rest on the yarn 2 with their entire force caused by their weight. An illustrative weight-relieving device 31 is represented in FIG. 4, which acts is on the lever 16 with a torque indicated by an arrow 32, which is counter to the torque caused by the weight of the lever 16 (arrow 33). The weight-relieving device 31 includes a spring element 34 in the form of a compressor spring. It is formed by a spiral spring 37 made of spring metal having two legs 35, 36. The two legs 35, 36 in this instance are angled away from each other.

The lever 16 is connected to a body 38, which is arranged concentrically with respect to the pivot axis 18 and, on its side facing the spiral spring 37, has a seating recess 39. The recess 39 receives the free end of the leg 36, while the other leg 35 is supported in a seating recess 41 of a contact element 42. The contact point between the leg 35 and the bottom of the recess 41 constitutes a seating or hinge point. In the same way, the contact point between the free end of the leg 36 and the bottom of the recess 39 is a seating or hinge point. The distance of the bottom of the seating recess 39 from the pivot axis 18 forms a short lever L, which forms an obtuse angle with respect to the connecting line between the recesses 39, 41.

The spiral spring element 37 extends in a direction toward a contact element 43, on whose free end a contact spring 44 is maintained. The latter is arranged in such a way that its free, tongue-like, resilient end projects into the pivot range of the spiral spring 37. Here, the pivot range is of such dimensions that the spiral spring element 37 does not touch the contact tongue 44 when the lever 16 is in the desired position, while the spiral spring element 37 comes into contact with the contact tongue 44, when the lever 16 is pivoted downward. The angular position of the lever L and the connecting line between the support points 41, 39 is of such dimensions that the torque 32 decreases when the lever 16 is pivoted downward. It initially moves toward zero and, when the support point 39 moves below the connecting line between the pivot axis 18 and the support point 41, it can also change its sign (i.e. direction) and thereby further increase the downward pivoting of the lever 16.

Figure 2:
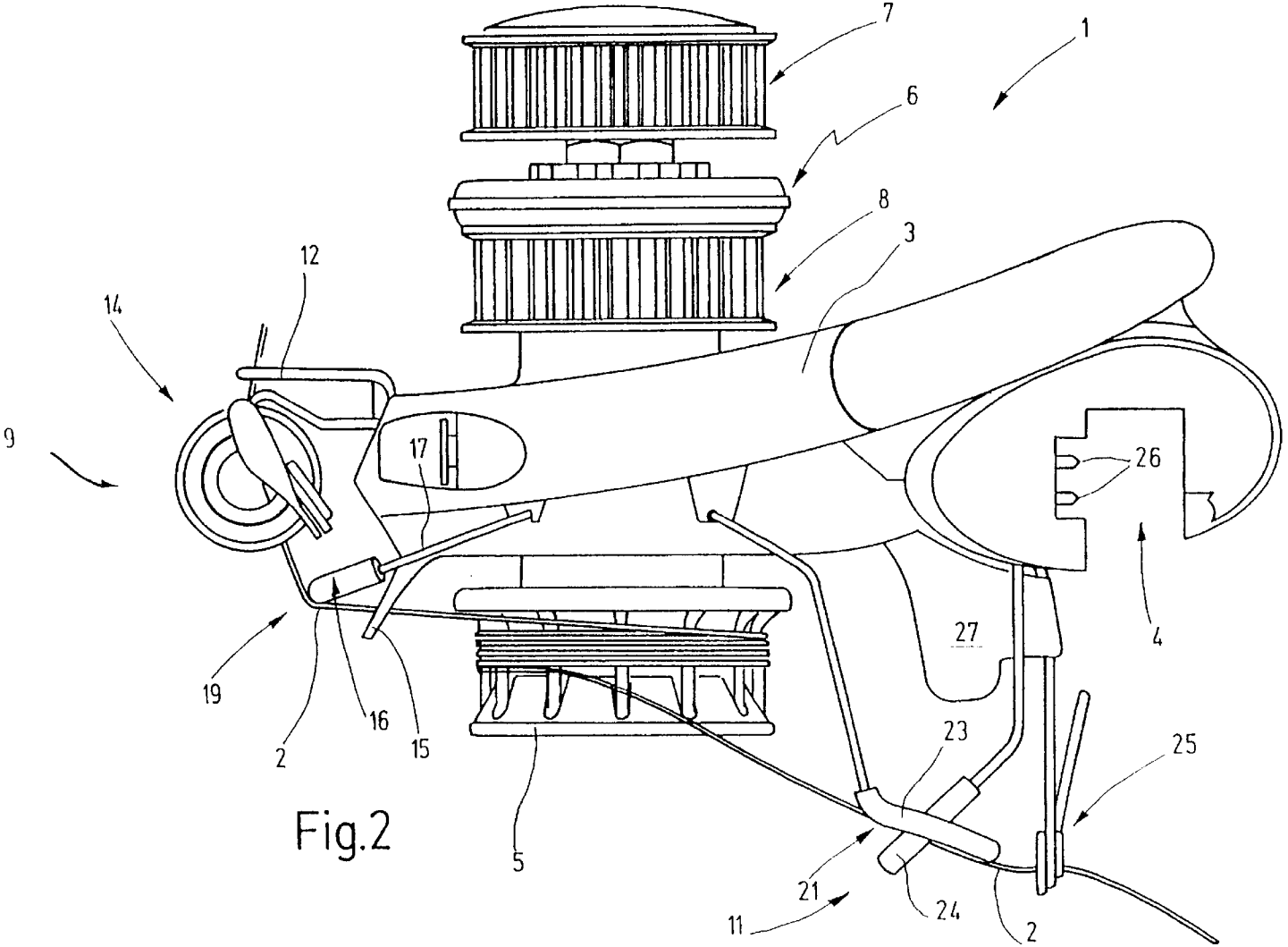
FIG. 2 is side elevational view of the yarn feeder shown in FIG. 1.
Figure 3:
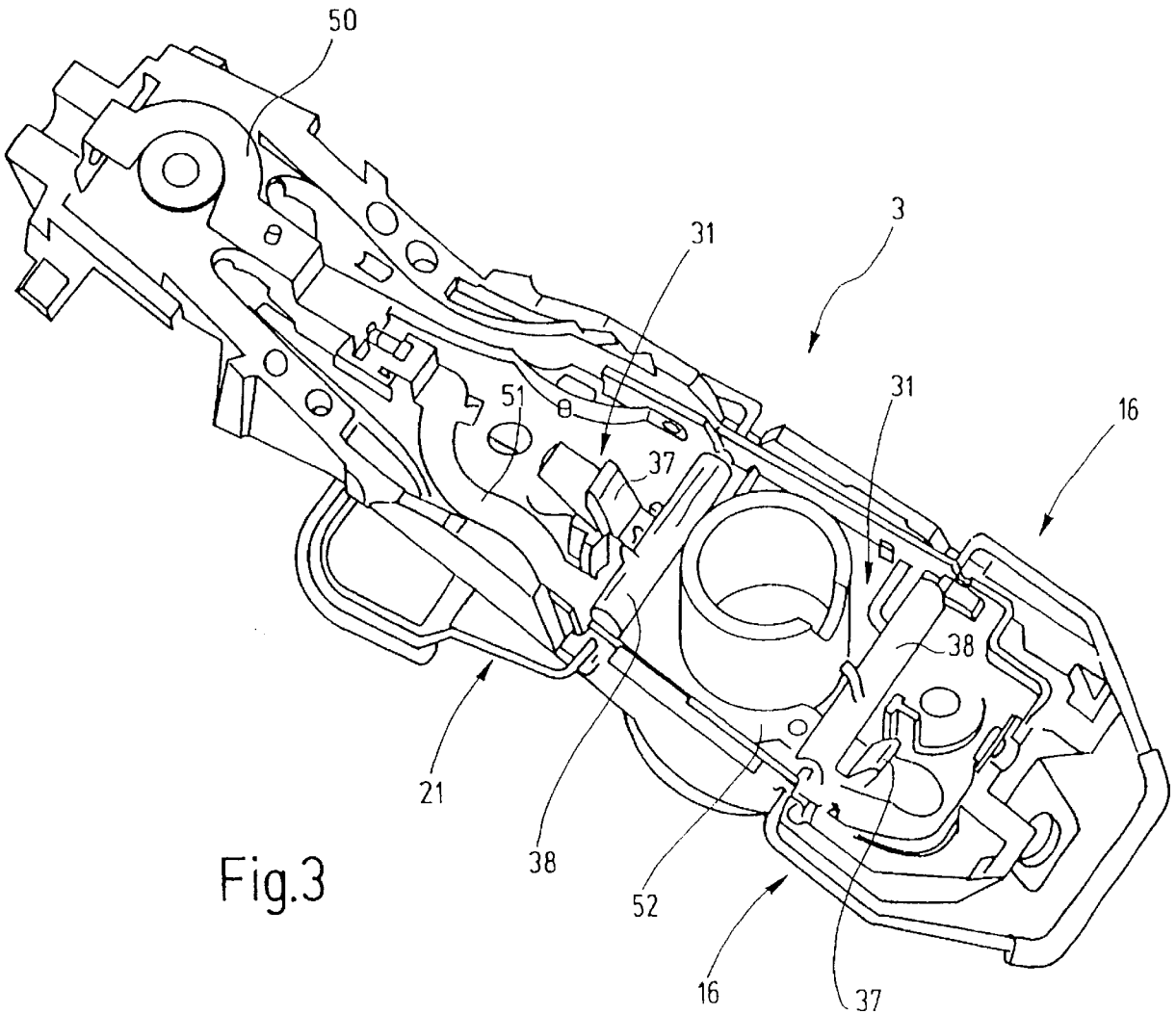
FIG. 3 is perspective of a housing element of the yarn feeder shown in FIGS. 1 and 2 with contact elements and a weight relief mechanism for yarn feeler levers of the yarn feeder in accordance with the invention.

As can be seen in FIG. 3, the lever 21 can also be provided with a similar relief device 31. Thus, both relief devices constitute electrical switches, which can be connected to the strip conductors 50, 51, 52. The strip conductors can be used for contacting the signal lamp 27, or respectively the contacts 26 (FIG. 2).

The yarn feeder 1 described above operates as follows:

As represented in FIG. 2, during operation the yarn 2 maintains both levers 16, 21 in the raised positions, in which the spiral springs 37 are not in contact with their respectively assigned contact tongues 44. Here, the spiral springs 37 support the levers 16, 21 and generate a torque acting opposite the torque generated by the respective inherent weight of the levers 16, 21 and partially compensates it. This opposite acting tongue is slightly less than the inherent torque of the respective levers 16, 21, so that the latter rests on the yarn 2 with a clearly reduced weight.

If, for example, a yarn break occurs at the yarn inlet, the yarn force maintaining the lever 16 in position falls off and the lever 16 initially pivots downward with a reduced force. However, the weight compensation is simultaneously reduced, so that now the lever is clearly and strongly pivoted downward and closes the associated switch. The same action occurs a yarn break takes place on the outlet side of the yarn feeder, or too large an amount of yarn is delivered, so that the yarn starts to sag between the yarn guide eyes 24 and 25.

From the foregoing, it can be seen that one or several yarn guide levers 16, 21 are provided in a yarn feeder 1, which rest on the yarn 2 with a force which is small in the desired position of the lever, i.e. when the yarn run is correct. If the lever pivots out because the yarn tension is reduced or the yarn has broken, the force with which the lever 16, 21 rests on the yarn 2 increases. This is caused, for example, by a weight-relieving device 31, which partially compensates the weight of the lever and provides a compensating force as a function of the pivot angle. With predetermined increased pivoting of the lever the compensation force is reduced.

What is claimed is:

1. A yarn feeder (1) for feeding at least one yarn to a textile machine comprising, a base support (3), a lever (16) supported on said base support (3) for a range of pivotal movement about a horizontal pivot axis (18), said lever having an end remote from the pivot axis (18) in contact with a yarn (2) under the force of its own weight, a relief device (31) connected to said lever (16) including a spring element (31) for reducing the weight of the lever (16) on the yarn (2) at least during a portion of its pivot range such that the lever (16) rests on the yarn with a reduced force less than its own weight.

2. The yarn feeder of claim 1 in which said relief device (31) is operable for reducing the weight of the lever (16) on the yarn by a first amount in a lever lifting pivot range in which said yarn (2) lifts the lever (16) to a desired operative position.

3. The yarn feeder of claim 2 in which said relief device (31) is operable to reduce the weight of the lever (16) on the yarn less than said first amount when the lever is lowered to a position below said lever lifting pivot range.

4. The yarn feeder of claim 2 in which said relief device (31) increases the force of the lever (16) on the yarn when the lever pivots below said lever lifting pivot range.

5. The yarn feeder of claim 1 in which said spring element (37) is a compression spring and acts on the lever (16) through a lever arm (L), and the pivot range of said lever (16) includes a position in which the angle between the lever arm (L) and the pressure spring element is 180°.

6. The yarn feeder of claim 1 in which said spring element (37) is a tension spring and acts on the lever arm (16) through a lever arm (L), and said pivot range of the lever arm (16) includes a portion in which the angle between the lever arm (L) and the spring element is 0.

7. The yarn feeder of claim 1 in which the lever arm (16) has an end (19) with a wear resistant element (23) in contact with the yarn (2).

8. The yarn feeder of claim 7 in which the wear resistant element (23) is a ceramic element whose weight is at least partially compensated for by the spring element (37) when the lever arm is in a portion of said pivot range.

9. The yarn feeder of claim 1 in which the lever arm (16) has a wear reducing coating in contact with the yarn (2).

10. The yarn feeder of claim 1 in which the spring element (37) is part of an electrical switch.

11. The yarn feeder of claim 1 in which said spring element is a spiral spring (37) bent in a U-shape with one leg (35) supported on an abutment (41) and another leg (36) supported on a lever arm (L) connected with the lever (16).

12. The yarn feeder of claim 11 in which said spiral spring legs (35, 36) are longer in length than the distance between the supported ends thereof.

13. The yarn feeder of claim 11 including a contact element (44), and said spiral spring (37) being movable into and out of contact in response to pivotal movement of said lever (16).

14. The yarn feeder of claim 13 in which said contact element (44) is mounted adjacent an end of the spiral spring at which the legs (35, 36) thereof are connected with each other.

15. The yarn feeder of claim 14 in which said relief device (31) reduces the weight of the lever (16) on the yarn when said remote end is moved upwardly to a predetermined level.

16. A yarn feeder (1) for feeding at least one yarn to a textile machine comprising, a base support (3), a lever (16) supported on said base support (3) for a range of pivotal movement about a horizontal pivot axis (18), said lever having an end remote from the pivot axis (18) in contact with a yarn (2) under the force of its own weight, a relief device (31) connected to said lever (16) including a spring element (31) for reducing the weight of the lever (16) on the yarn (2) by a first amount during a first pivot range of movement of the lever such that the lever (16) rests on the yarn with a reduced force less than its own weight, and said relief device (31) being operable for reducing the weight of the lever (16) on the yarn (2) by a second amount different from the first amount during pivotal movement of the lever (16) in a second pivot range different from the first pivot range.

17. The yarn feeder of claim 16 in which said spring element is a spiral spring (37) bent in a U-shape with one leg (35) supported on an abutment (41) and another leg (36) supported on a lever arm (L) connected with the lever (16).

18. The yarn feeder of claim 17 including a contact element (44), and said spiral spring (37) being movable into and out of contact in response to pivotal movement of said lever (16).

19. A yarn feeder (1) for feeding at least one yarn to a textile machine comprising, a base support (3), a lever (16) supported on said base support (3) for a range of pivotal movement about a horizontal pivot axis (18), said lever having an end remote from the pivot axis (18) in contact with a yarn (2) under the force of its own weight, a relief device (31) connected to said lever (16) including a spring element (31) for reducing the weight of the lever (16) on the yarn (2) during a first pivot range of movement of the lever such that the lever (16) rests on the yarn with a reduced force less than its own weight, and said relief device (31) being operable for increasing the force of the lever (16) on the yarn (2) during pivotal movement of the lever (16) in a second pivot range different from the first pivot range such that the lever (16) rests on the yarn (2) with a force greater than its own weight.

20. A yarn feeder (1) for feeding at least one yarn to a textile machine comprising, a base support (3), a lever (16) supported on said base support (3) for a range of pivotal movement about a horizontal pivot axis (18), said lever having an end remote from the pivot axis (18) in contact with a yarn (2) under the force of its own weight, a relief device (31) connected to said lever (16) including a spring element (31) for reducing the weight of the lever (16) on the yarn (2) by a first amount during a first pivot range of movement of the lever such that the lever (16) rests on the yarn with a reduced force less than its own weight, and said relief device (31) being operable for reducing the weight on the lever (16) on the yarn (2) by a second amount different from the first amount during pivotable movement of the lever in a second pivot range different from the first pivot range.

* * * * *